US007648141B2

(12) United States Patent
Strohm

(10) Patent No.: US 7,648,141 B2
(45) Date of Patent: Jan. 19, 2010

(54) BASEBALL SIMULATION GAME

(76) Inventor: Douglas William Strohm, 2459 215th Ave. SE., Sammamish, WA (US) 98075

( * ) Notice: Subject to any disclaimer, the term of this patent is extended or adjusted under 35 U.S.C. 154(b) by 0 days.

(21) Appl. No.: 12/118,490

(22) Filed: May 9, 2008

(65) Prior Publication Data

US 2008/0277868 A1 Nov. 13, 2008

Related U.S. Application Data

(60) Provisional application No. 60/917,009, filed on May 9, 2007.

(51) Int. Cl.
*A63F 7/06* (2006.01)
*A63F 7/20* (2006.01)

(52) U.S. Cl. ..... 273/317.7; 273/317.9; 273/108.31; 273/108.32; 273/119 R; 273/123 R

(58) Field of Classification Search . 273/108.3–108.33, 273/108.53, 108.55, 244.1, 277, 129 R–129 W, 273/317.7, 317.9, 119 R, 123 R; D21/315
See application file for complete search history.

(56) References Cited

U.S. PATENT DOCUMENTS 401,222 A * 4/1889 Smith ..... 273/108.31
487,825 A * 12/1892 Curtis ..... 273/108.31
491,247 A * 2/1893 Meaher ..... 273/108.31
968,249 A * 8/1910 Meeker ..... 273/108.31
1,048,047 A 12/1912 Curtis
1,053,788 A * 2/1913 Crew ..... 273/317.7
1,094,559 A * 4/1914 Harrison ..... 273/317.7
1,122,141 A * 12/1914 McIlroy ..... 273/108.31
1,296,882 A * 3/1919 Vance ..... 273/108.31
1,298,591 A * 3/1919 Smith ..... 273/108.3
1,492,127 A 4/1924 Fox
1,507,256 A * 9/1924 Severe ..... 273/108.31
1,551,216 A 8/1925 Potter
1,642,093 A * 9/1927 Stewart ..... 273/108.32
1,662,317 A * 3/1928 Livingston ..... 273/108.31
2,462,170 A 2/1949 Dube
2,488,919 A * 11/1949 Mansfield ..... 273/317.9
2,511,048 A 6/1950 Clark
2,534,468 A * 12/1950 Mitchell ..... 273/317.7
2,631,854 A 3/1953 Volman
2,645,489 A 7/1953 Burgess (Continued)

*Primary Examiner*—Sebastiano Passaniti
(74) *Attorney, Agent, or Firm*—Christensen O'Connor Johnson Kindness PLLC

(57) ABSTRACT

A baseball simulation game includes a standard or universal base unit or structure (20) on which is placed a removable playing field surface (22), as well as a removable outfield fence configuration (24). The playing surface (22) and fence configuration (24) can be changed so that the game unit (20) models or resembles different baseball parks or stadiums that currently exist, that previously existed, or that are fictitious. A pitching pipe (26) is positioned in center field, in alignment with second base (27B), pitching mound (27A), and home plate (27). The ball is pitched by being propelled down the pipe (26) toward home plate (27). The batter operates a bat (80) by pushing or pulling on batting rod (50), having a knob or handle (81) positioned adjacent home plate (27) and a second knob adjacent the entrance end of the pitching pipe (26). Openings are placed in the lower portion of the outfield fence (24) through which the ball is batted, thereby to achieve hits and score runs.

19 Claims, 9 Drawing Sheets

U.S. PATENT DOCUMENTS

| | | | | | |
|---|---|---|---|---|---|
| 2,672,343 | A | | 3/1954 | Auger | |
| 2,775,457 | A | | 12/1956 | Galbos | |
| 2,980,427 | A | | 4/1961 | Cragg | |
| 3,009,452 | A | | 11/1961 | Barber | |
| 3,227,452 | A | | 1/1966 | Murphy | |
| 3,355,173 | A | | 11/1967 | Selker | |
| 3,358,997 | A | | 12/1967 | Belz | |
| 3,534,962 | A | | 10/1970 | Singleman | |
| 3,705,723 | A | | 12/1972 | Eissler | |
| 3,741,544 | A | * | 6/1973 | Wolff, Jr. | 273/126 R |
| 3,814,425 | A | * | 6/1974 | Kanefield et al. | 273/108.31 |
| 3,879,037 | A | | 4/1975 | Cooke | |
| 4,017,074 | A | | 4/1977 | Roberts | |
| 4,116,442 | A | | 9/1978 | Dickey | |
| 4,179,123 | A | * | 12/1979 | Tsukuda | 273/108.31 |
| 4,251,074 | A | | 2/1981 | Welker | |
| 4,602,786 | A | | 7/1986 | Valentino | |
| 4,715,603 | A | | 12/1987 | Gleason | |
| 4,830,374 | A | * | 5/1989 | Follo | 273/317.7 |
| 4,877,244 | A | * | 10/1989 | Burrows et al. | 273/108.31 |
| 4,948,135 | A | | 8/1990 | Follety, Jr. | |
| 4,976,434 | A | * | 12/1990 | Wikner | 273/108.31 |
| 5,125,658 | A | | 6/1992 | Francis | |
| 5,988,636 | A | * | 11/1999 | Kilmer | 273/108.1 |
| 6,533,272 | B2 | | 3/2003 | Hylak | |
| 6,805,348 | B1 | * | 10/2004 | Chen | 273/108.32 |

* cited by examiner

BASEBALL SIMULATION GAME

CROSS-REFERENCE TO RELATED APPLICATION

This application claims the benefit of U.S. Provisional Application No. 60/917,009, filed May 9, 2007, the disclosure of which is hereby expressly incorporated by reference.

TECHNICAL FIELD

The present invention relates generally to games, and more specifically to a mechanical baseball game that simulates a real baseball game played by opposing teams of players on a playing surface.

BACKGROUND

Many types of baseball games have been developed over the years to provide entertainment and to simulate a natural baseball game. The earliest games were created in the 1860s as board or table-top games. Typically, a baseball playing field is depicted on a game board. In the early games, dice, a spinner, or cards were used to simulate most of the events or actions that occurred in the game; including, for example, whether a batter struck out, walked, or achieved a hit. Some of these games were based on actual baseball statistics, while others consisted of made-up players and teams. In some of these games, the dice, spinner or cards also controlled or dictated the defensive aspects of the game, including whether the hit ball was caught, dropped, or the type of play made by the fielder. Generally these games follow the rules of baseball in that the team batting sought to score as many runs as possible, whereas the team in the field sought to achieve three outs with as few runs scored as possible.

One disadvantage of the foregoing types of table-top games is that they did not actually simulate the actual playing conditions of baseball. The rolling of dice, the spinning of a spinner, or the selection of a card did not bear any actual relationship to the skills and odds involved in the baseball game, including pitching the ball, attempting to hit the ball, and attempting to field the ball.

In addition to the foregoing reasons and others, "mechanical" types of baseball simulation games were developed. In such games, typically a ball or substitute for a ball is pitched by one player and a second player attempts to hit the ball to advance runners and thereby score runs. In some games, simulated fielders are used for determining if the hit ball was scored as a run or a hit, depending on where and how far the ball was hit by the batter. These types of mechanical games differed from dice, spinning, or cards games in that the outcome of the game typically was at least in part determined by the motor skills of the players, rather than simply leaving the game's outcome to the laws of chance.

In prior mechanical games, the ball or ball substitute, such as a round disc, might be pitched in a number of ways. For example, the ball or disk might be pushed or flicked by the finger of the player serving as pitcher. Alternatively, the ball might be propelled along a close-fitting barrel or trough by some type of striking mechanism, such as a spring-loaded plunger. Another technique for pitching the ball is via catapult-type mechanism. Another way for pitching the ball is to provide a ramp or trough sloped downwardly with the ball propelled by gravity or perhaps propelled with the assistance of a striker mechanism that might be spring-loaded. The ramp or trough may be rotatable so as to pitch the ball over the plate or perhaps to pitch an inside or outside ball. With the striking mechanisms used, the striker might strike the ball on one side or the other or in the center to change the spin placed on the ball in an attempt to throw a curve ball or a slider.

The manner of batting in mechanical games also has varied greatly. In some games, the player actually holds a miniature bat in his/her fingers and swings the bat at the pitched ball. Also commonly the bat is mounted on a rotatable post structure. The post may be spring-loaded with the release mechanism controlled by the player when desiring to swing the bat. In other batting mechanisms, the player might physically flick or push on the handle of the bat to swing the bat about its mounting post.

Some mechanical games also simulate infield and/or outfield players who field the hit ball. Such fielders are typically placed at their standard positions on the simulated baseball playing surface. The fielders may be in the form of hoods, baskets, V-shaped brackets or barriers, shallow circular cylinders, curved barriers, etc. The objective is to stop the travel of the ball hit by the batter, thereby to record an out or limit the number of bases to which the batter advanced. Also, in some games the structure of the playing field or outfield fence is designed to determine whether the hit ball constitutes an out, a single, a double, a triple, a home run, or a foul ball. In some games this is achieved by dividing the length of the outfield fence into different sections, with the particular section to which the ball is hit determining whether the ball was a single, a double, a triple, or home run. In other games, openings were placed in the outfield fence, and if the ball was hit through an opening, the particular opening dictated if the ball was a single, a double, a triple, or a home run. In other games, depressions or pockets were formed in the playing field, and depending on what pocket the ball lands in determines whether the ball is an out, a single, a double, a triple, or a home run.

Recent developments in baseball games include computer and video games. In these games, all of the different players in a baseball games are typically employed. However, like dice, spinning or card games, video/computer games may bear little relationship to the motor skills actually used in playing baseball. The same is true in fantasy baseball leagues where one selects the players for his/her team from actual Major League players. The performance of a fantasy team depends on the performance of the actual Major League baseball players. Most fantasy baseball games are more akin to functioning as a general manager of a baseball team as opposed to an actual participant.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present disclosure provides a game apparatus permitting one, two or more players to play a simulated baseball game. In this regard, the game is played on a field that resembles an actual baseball diamond and outfield. One player pitches the ball using an elongate pitching pipe that allows the pitcher to throw the different types of actual baseball pitches; for example, fastball, changeup, curve ball, slider. Also, the location of the ball, whether over the plate, inside or outside, can also be controlled by the pitcher, depending on how the ball is propelled and released in the pitching pipe.

The batter controls the offensive aspects of the game by swinging a bat utilizing a push-pull mechanism. The batter can time the swing depending on the type of pitch thrown as well as the desired location to which to hit the ball.

In another aspect of the present invention the pitching pipe is substantially larger in diameter than the diameter of the ball, thereby allowing the ball to move about relative to the inside diameter of the pitching pipe when throwing different types of pitches, as noted above.

In another aspect of the present invention the entrance end of the pitching pipe may be screened by a scoreboard or other structure of the game so that the batter cannot tell the type of pitch the pitcher is throwing until the ball leaves the forward or proximal end of the pitching pipe at a location some place between the outfield and the pitcher's mound.

In accordance with a further aspect of the present invention, at least the infield portion of the playing surface is textured or composed of a substance to create a desired level of frictional interaction between the playing surface and the ball. Thus, the particular spin placed on the ball will cause the ball to travel in a desired path, for instance curve toward or away from the batter.

In a further aspect of the present invention, the outfield fence extends upwardly from the playing surface. Openings may be formed in the lower portion of the outfield fence to enable a ball struck by the batter to pass therethrough. The openings may be of different sizes, thereby to simulate single, double, or triple.

In accordance with a further aspect of the present invention, both the playing surface and the outfield fence may be readily removable and replaceable from an underlying base structure. This enables different playing fields or baseball stadiums to be simulated, for example, Wrigley Field with its brick outfield wall, Fenway Park with its "Green Monster," or Safeco Field with its spacious outfield.

In another aspect of the present invention, the batting mechanism is controllable from a location adjacent home plate, and also location adjacent centerfield so that a single player can both pitch the ball and bat the ball, thereby enabling the simulated baseball game of the present disclosure to be played by a single person.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The present invention pertains to a baseball simulation game and, more particularly, to a "table top" type baseball simulation game, which is entirely mechanical and non-electrical. The game has a common frame and base unit, pitching mechanism and batting mechanism, but with a removable playing field surface and outfield fences so that the game can be easily configured to closely resemble different baseball parks and stadiums, as desired, including actual baseball parks and stadiums.

Figure 1:
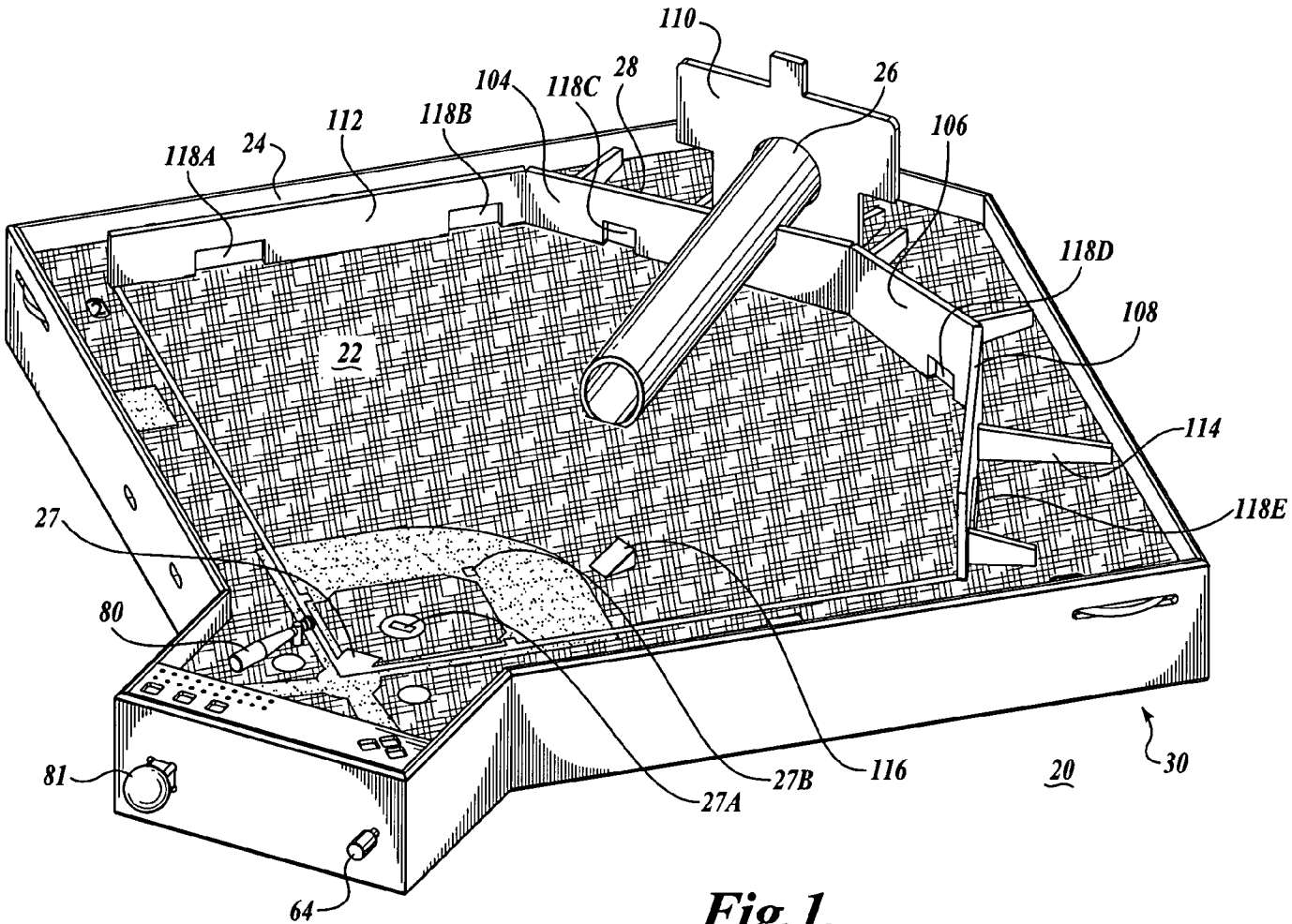
FIG. 1 is a pictorial view of the present invention showing a particular field configuration installed on a standard base unit.

FIG. 1 shows a substantially assembled game unit 20 with a removable playing field surface 22, an outfield fence configuration 24, and a pitching pipe or tube 26 which is in alignment between home plate 27, the pitching mound 27A, and second base 27B, but positioned primarily in the outfield. The pitching pipe is supported in part by the centerfield fence section 28. Optionally a screw, Velcro®, clip, or other device (not shown) can be used to attach the proximal end of the pitching pipe to the playing field surface.

Figure 2:
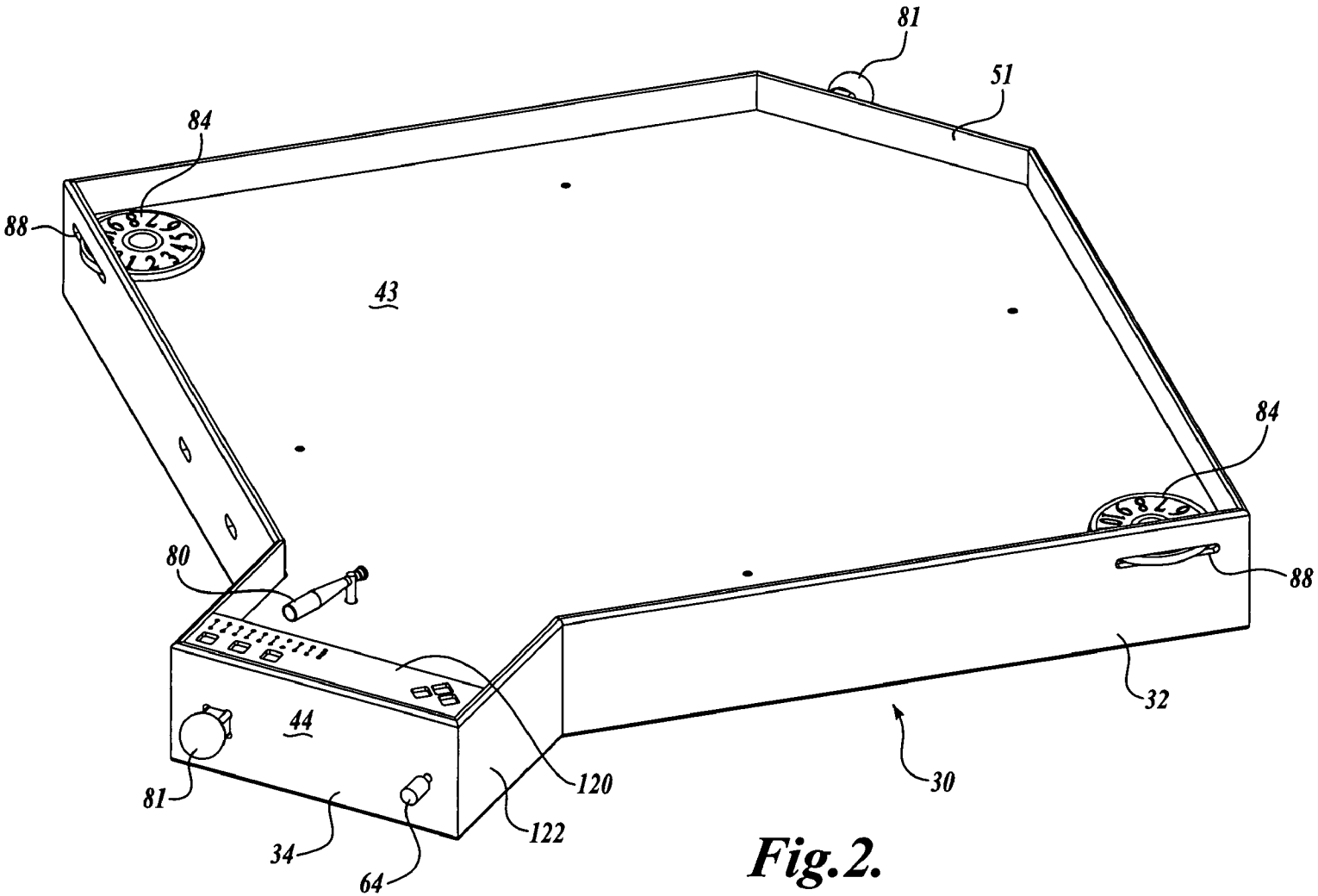
FIG. 2 is a view similar to FIG. 1, but with the playing field surface removed and with the outfield fences removed and with the pitching pipe removed and with the scoreboard removed.
Figure 3:
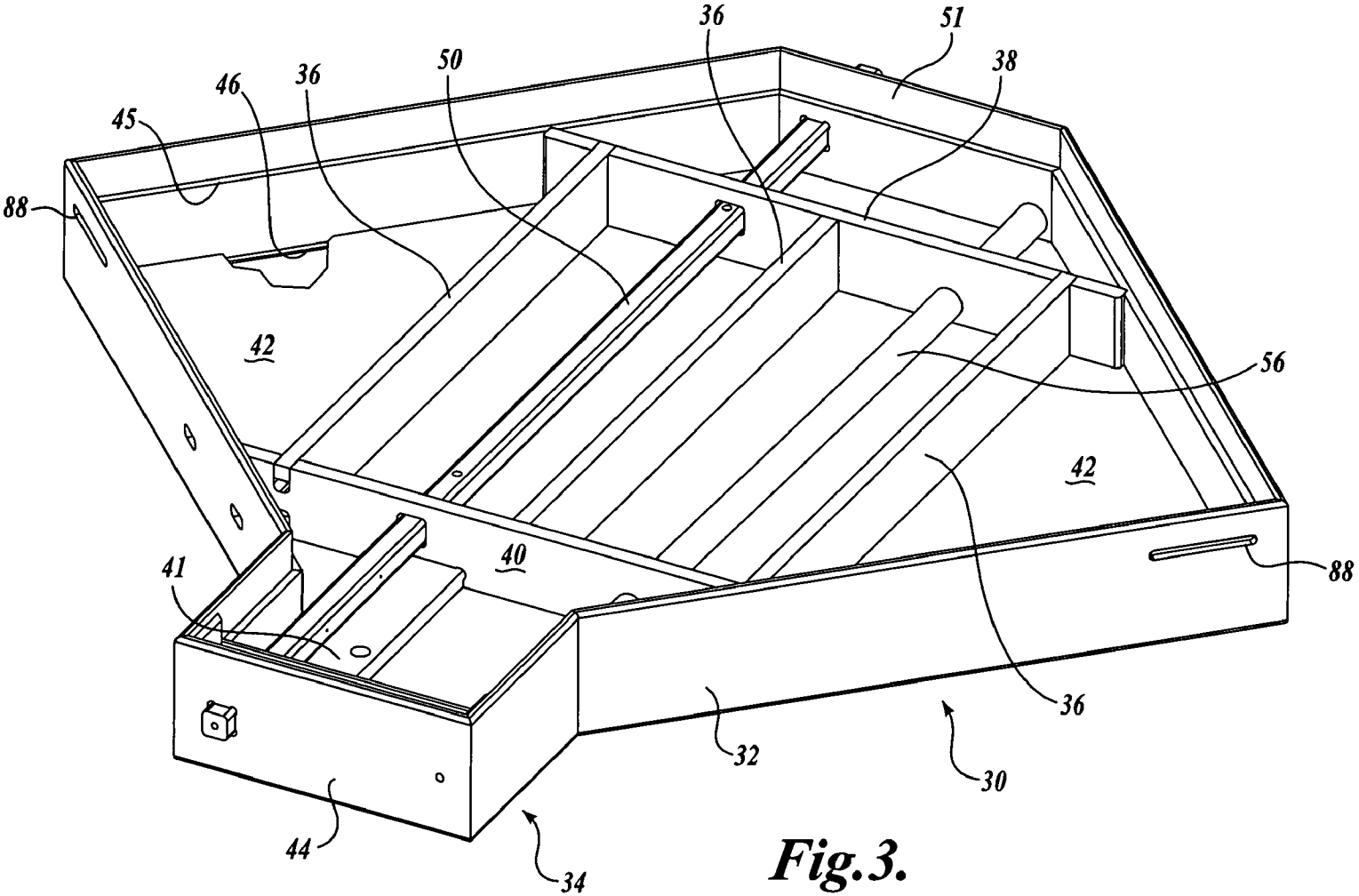
FIG. 3 is a view similar to FIG. 2, but with the upper board and other components removed to show the underlying framework, including the bat operating push-pull shaft and the ball return tube.

The game 20 unit includes a standard base unit or structure 30, shown in FIGS. 2 and 3. The base structure includes a perimeter frame 32 of a generally rectilinear shape, but with an extended backstop or home plate section 34 extending rearwardly behind home plate 27. The perimeter frame is composed of edgewise positioned wall members. The frame is shown as reinforced by three longitudinal bracing members 36 positioned on their edges in spaced parallel relationship and attached at their ends to transverse bracing members 38 and 40 and may intersect the perimeter frame 32. An anchoring plank 41 extends from a back wall 44 of the backstop 34 to the transverse brace 40. The plank is in flat orientation and, as described below, serves as a mounting member for the batting system of the game unit 20. A flat, relatively thin bottom board 42 underlies the lower edges of the bracing members 36, 38, and 40 and engages within a close-fitting lower groove 46 formed along the inside surface of the perimeter frame. Likewise, a flat upper board 43 overlies the upper edges of bracing members 36, 38, and 40 to engage within a close-fitting upper groove 45 formed along the inside surface of the perimeter frame 32 (see FIG. 3). The boards 42 and 43 can simply lie against the bracing members 36, 38 and 40, or be detachably fixed attached to the bracing members as desired or as required for the structural integrity of the base unit 30.

Figure 4:
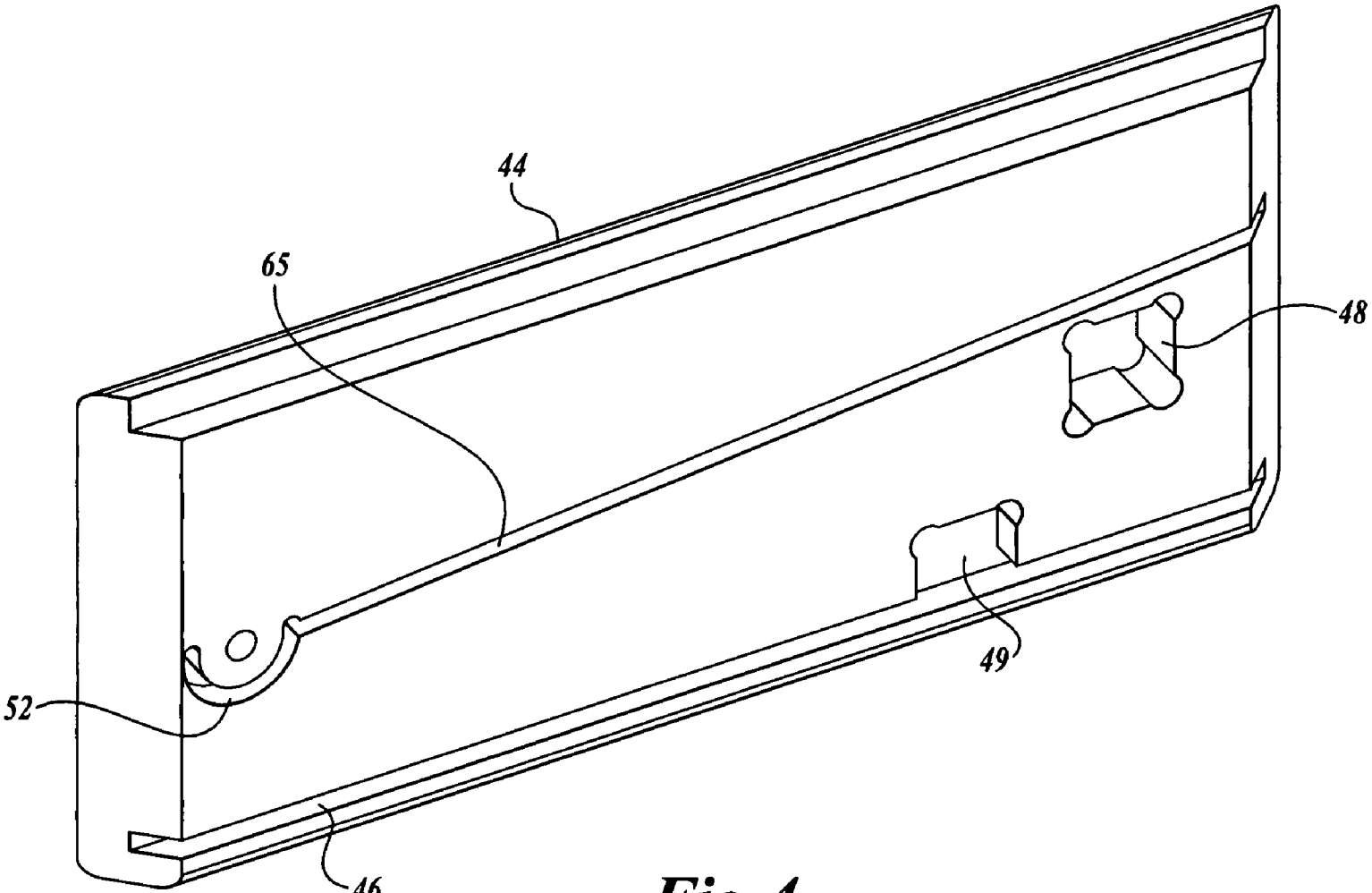
FIG. 4 shows an elevated view of the backstop section of the perimeter frame to illustrate the general construction of the sections of the perimeter frame.
Figure 5:
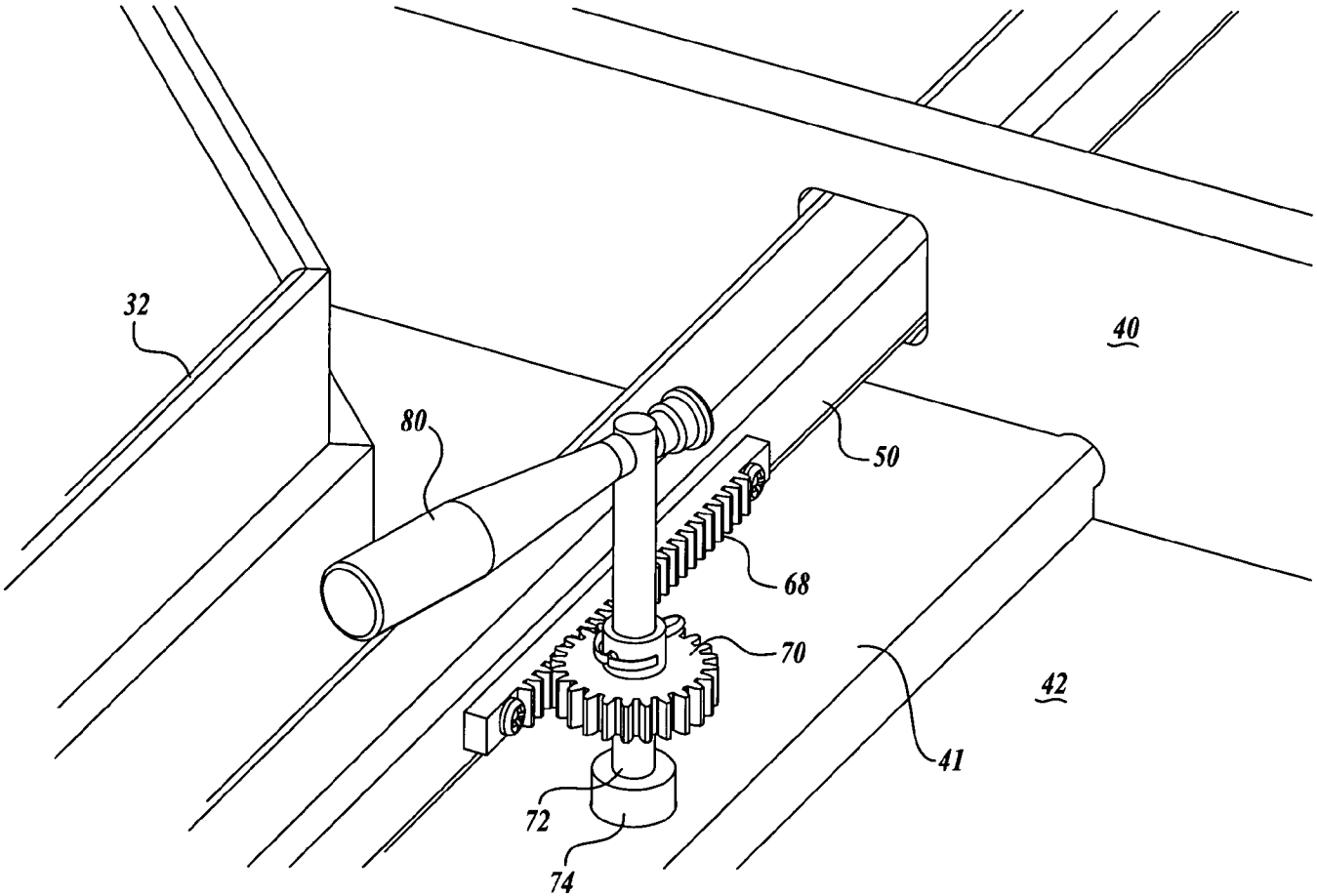
FIG. 5 is a fragmentary, enlarged, isometric view of the bat actuating system including a rack mounted on the push-pull rod, engaged with pinion mounted on a pivot post with a bat mounted at the upper end of the pivot post.

FIG. 3 shows the general construction of the backstop section 34 of the perimeter frame which is located behind home plate. FIGS. 3 and 4 show the back wall 44 of the backstop section 34. A lower groove 46 is formed in the inside surface of back wall 44 as well as the walls of the backstop section, to receive the bottom board 42. A square opening 48 is formed in back wall 44 for receiving the push-pull batting rod 50, shown in place in FIG. 3. Also, a rectilinear blind hole 49 is formed in the inside surface of the back wall to receive the adjacent end of the anchoring plank 41.

The rod 50 is of generally square cross-section with beveled corners, but may be of other cross-sectional shapes, such as hexagonal, octagonal, round, oval, etc. Square openings 48 are also formed in transverse brace members 38 and 40 as well as in the far centerfield frame perimeter section 51 opposite to the backstop perimeter frame section 44.

The wall 44 of the backstop perimeter frame section 34 also has an arcuate groove 52 for receiving the corresponding end of ball return tube 56 shown in FIG. 3 and as described below. The ball return tube 56 is also supported by the transverse reinforcing members 40 and 38 and extends rearwardly to or through a close-fitting opening formed in the perimeter frame section 51 opposite home plate. As shown in FIG. 3, the ball return tube is sloped downwardly in the direction towards the outfield so that balls received in the proximal end of the tube (near home plate) will roll by gravity toward the outfield, but underneath the playing surface 22.

Figure 6:
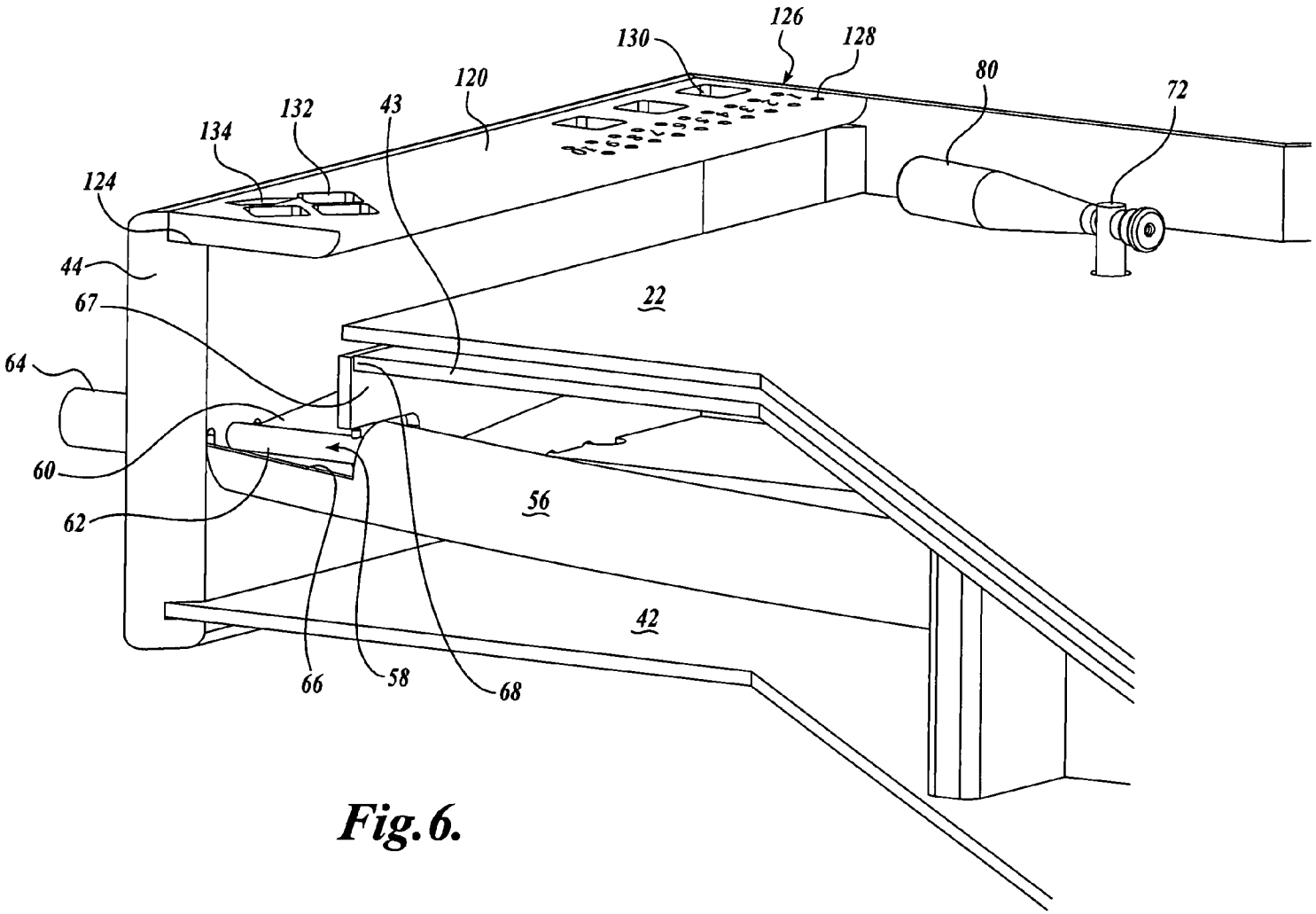
FIG. 6 is an enlarged partial cross-section of the present invention showing portions of the frame, frame bottom board, frame upper board, playing surface, bat, and ball return tube.

FIG. 6 shows the proximal end of the circular ball return tube 56 with a cut-out or opening 58 formed in the upper portion of the tube end. A ramp 60 is positioned along the inside of the backstop section 34 of the perimeter frame for directing balls to the opening 58 of the return tube 56. A blocking rod 62 is nominally positioned at the lower end of the ramp 60 to prevent balls that accumulate on the ramp to enter the return tube opening 58 until the exterior knob end 64 of the rod 62 is pulled rearwardly, thereby to allow the accumulated balls to enter the return tube 56. Portions of the playing field surface 22 and the upper board 43, adjacent the backstop perimeter frame section 34, do not extend all the way to the inside surface of the wall 34 so that balls may fall off the playing field surface and onto ramp 60, especially the balls that the batter misses as described below.

Referring specifically to FIGS. 4 and 6, the ramp 60 is positioned in place by engaging within a sloped groove 65 shown in FIG. 4 extending on the inside surface of backstop section 44. The lower edge of the ramp abuts or is closely adjacent the exterior of the ball return tube 56, with the upper surface of the ramp closely coinciding with the upper edge 66 of the return tube opening 58. Also, a sidewall 67 extends downwardly from the adjacent edge 68 of the upper board 43 to at least the elevation of the ramp 60, thereby to prevent balls from rolling off the ramp and falling beneath the upper board 43. Rather, all of the balls are directed downwardly to return tube opening 58.

FIG. 6 shows the bat actuating system composed of the push-pull batting rod 50 and a rack 68 mounted along a side surface of the batting rod. The teeth of the rack engage with a pinion gear 70 mounted on the upper end of an upright pivot post 72. The bottom end of the pivot post 72 is rotatably received with a collar 74 securely mounted to the anchor plank 41. A close-fitting opening 76 is formed in the upper board 43 (see FIG. 7). A collar or similar device can be positioned within such opening to closely receive the pivot post, thereby to help stabilize pivot post and function as a bearing surface for the upper end portion of the pivot post. A bat 80 is transversely secured to the upper end of the pivot post 72. The handle portion of the bat extends through a close-fitting cross hole formed in the upper end of the post 72 and a retaining knob 81 is secured to the handle outward of the post to secure the bat to the post. The knob 81 can be screwed or otherwise affixed to the bat handle. As can be appreciated, the bat 80 may be rotated by pushing or pulling on either end of the batting rod 50. A round or other shaped knob 81 is attached to both ends of the bat outward of the perimeter frame 32 to be conveniently gripped when pulling or pushing on the rod during batting.

FIG. 3 shows the bottom board 42 and FIG. 2 shows the upper board 43. These surfaces are common to all baseball stadium and park configurations of unit 20. FIG. 2 also shows rotatable discs 82 and 84 positioned in the outfield corners with indicia thereon to be used to indicate the score of the game. The discs 83 and 84 are rotatable so that one number at a time is in registry with oval-shaped openings 86 formed in the playing surface 22 (see also FIGS. 1 and 7). Elongate slots 88 are formed in the adjacent portions of the perimeter frame to enable a portion of the outer perimeters of the discs 82 and 84 pass therethrough so that the discs can be rotated by the game players to change the score. Indicia can be placed on the playing surface 22 next to the slots 86 to indicate which score is for the home team and which is for the visiting team.

Figure 7:
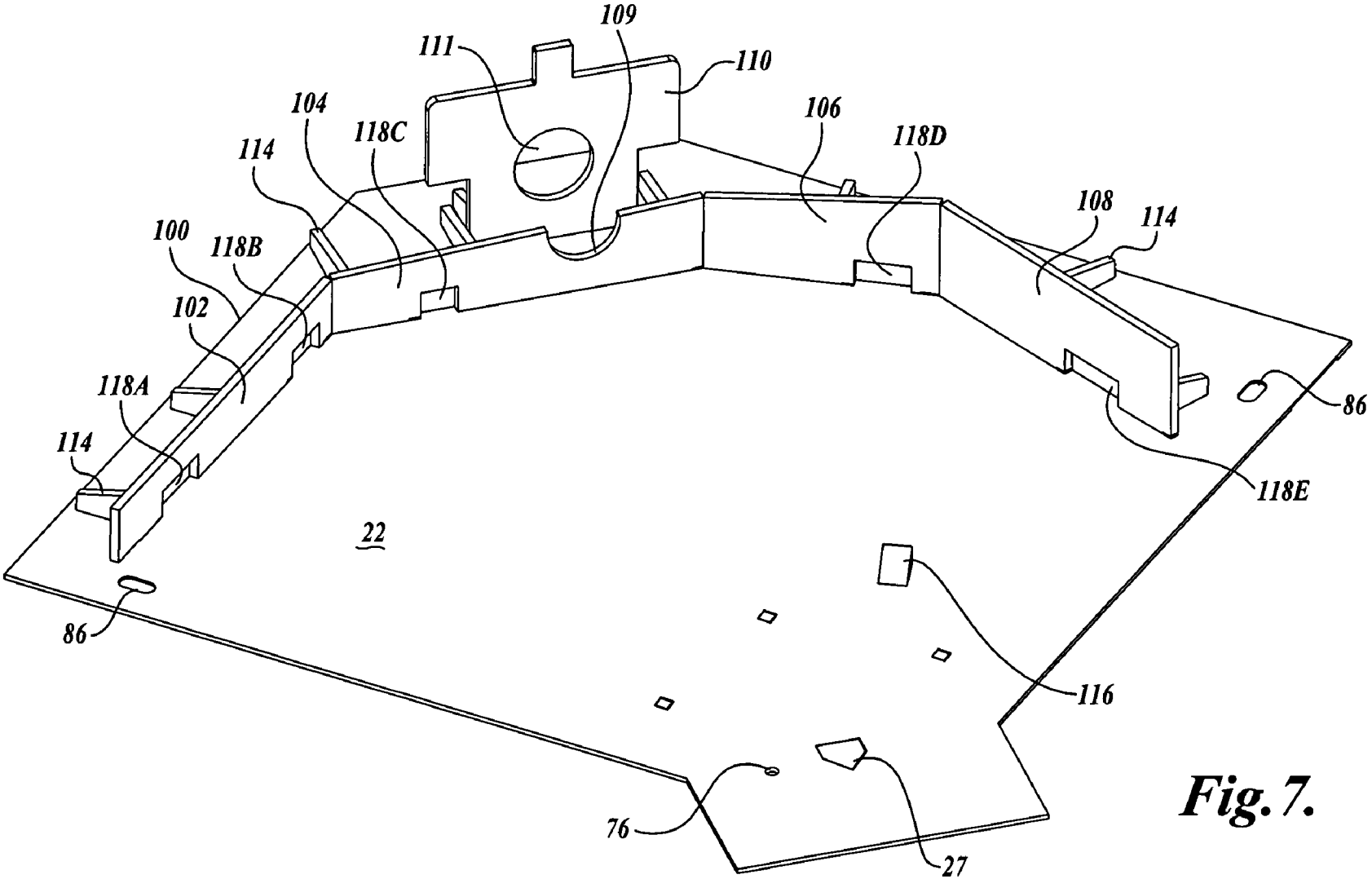
FIG. 7 shows a specific playing field surface with outfield fences and scoreboard support system for the pitching pipe.

FIG. 7 shows the playing field surface 22 and an outfield fence 100 composed of a left field section 102, a left center field section 104, a right center field section 106, and a right field section 108. A semicircular aperture 109 is formed in the upper portion of the left center field fence in alignment with a circular hole 111 formed in a scoreboard 110 for receiving the pitching pipe 26 therein.

As will be appreciated, the configuration of the outfield fence 100 shown in FIG. 7 is different from the outfield fence configuration shown in FIG. 1. It is contemplated by the present invention that any desired ballpark can be simulated by the configuration of the outfield fence, scoreboard, optionally the playing surface 22, and other specific features.

The playing field surface 22 is preferably composed of a rigid underlayer covered or overlayed with a top surface material that imposes a desired level of friction against the ball that rolls along the field, especially when pitched by being rolled down the pitching pipe 26. One possible material for the playing surface 22 is a fabric, such as felt. Alternatively, fibers or other material may be adhered to the underlay by spraying or other well-known technique. The top covering can be colored or otherwise treated to depict the particular infield and outfield configuration of the desired ballpark, as well as the bases, home plate, the pitching mound, and the dirt along the base paths and around each of the bases. The top covering of the playing surface 22 can also be colored or otherwise treated to depict the foul lines, the warning track in the outfield, and the pattern in which the grass in the field is mowed. As is known, the mowing pattern differs from ballpark to ballpark.

Slots (not shown) can be provided to extend through the playing surface 22 to receive the lower edges of the outfield fence sections shown in FIG. 97. The bottom edges of such fence sections can "bottom" against the top surface of the upper board 43. Also, slots can be provided for receiving the lower edge portions of the scoreboard/tube support section 110. In addition, reinforcing bars 114 may be used to reinforce the outfield fence 100, see FIGS. 1 and 7. Reinforcing bars 114 can overlie the playing field surface 22 and extend rearwardly from the bottom edges of the outfield fence sections to terminate at or near the perimeter frame 32. The reinforcing bars 114 may be attached to the outfield fence sections 102-108 by any convenient means, such as by use of screws or other hardware members. Also, if desired, the reinforcing bars may be fastened downwardly onto the playing surface 22 by hardware members or other means.

One or more ramps 116 can be positioned about the playing field so that a ball struck by bat 80 may roll up the ramp 116 and fly over the outfield fence, see FIG. 7. Also, openings 118A-118E are formed in the bottoms of outfield fence sections through which the ball may pass through when hit. These openings can represent a single, a double, or a triple depending on the location of the opening and the size of the opening. The placement and size of the openings can be selected to simulate the characteristics of actual baseball parks. In FIG. 7, the openings that correspond to a single are designated with an "S," the openings that represent a double are designated by "D," and the opening that represents a triple is designated with a "T." Of course, the full words "Single," "Double," "Triple" can be used instead. These indicia can be applied to the playing surface 22 or to the outfield fence sections.

Indicia can also be applied to the outfield fence 100 to simulate a fictitious or actual ballpark. For instance, the distances from home plate can be applied to the outfield fence sections. Advertisements may also be applied to the outfield fence sections to resemble an actual ballpark or to simulate a fictitious ballpark. The scoreboard 110 can be positioned and configured to resemble the scoreboard in an actual ballpark, including the placement of advertisements on the scoreboard, the location where the game score is shown on the scoreboard, as well as other specific scoreboard features. Additional decorations may be added to the game unit 20 to resemble actual ballparks. For example, in some ballparks the flags of the various major league teams are flown, with the relative positions of the flags indicating the current team standings.

Referring to FIGS. 2 and 6, a ledge section 120 is positioned across the extended home plate section 34 of the frame 32. The ledge section 120 spans between the side sections 122 of the frame home plate section 34. A shoulder 124 is formed along the upper edge portion of the back wall 44 of the home plate section for receiving the adjacent portion of the ledge section 120. The ledge section 120 is configured to help keep track of the number of outs, the current inning, as well as the position of base runners.

With respect to the innings, indicia 126 composed of the numbers 1 through 10 are formed on the ledge section. Adjacent each number is a vertical hole 128 for receiving a rod, pin, dowel, or similarly shaped object that may be pushed into the hole to indicate the inning of play. Optionally, the holes 128 may be positioned above and below each of the numbers of the indicia 126 so as to indicate whether it is the top or bottom of a specific inning.

Three shallow depressions 130 formed in the ledge section 120 adjacent the indicia 126. Balls or other markers may be placed in the depression to indicate the number of outs that exist. Indicia such as: "1," "2" and "3" can be placed adjacent the depression to also help indicate the number of outs that exist.

In addition, the ledge section, as noted above, can be used to keep track of the position of the base runners. To this end, three diamond-shaped depressions 132 are formed in a pattern in the upper surface of the ledge 120 to resemble first, second, and third base. Also, an indicia 134 is applied to the ledge section 120 to resemble home plate. If the game player hits a single, a ball or other type of playing piece may be placed in the appropriate depression 132. If the next player also hits a single, a ball or playing piece may be placed in the depression representing second base to indicate that base runners are on first and second. In this manner, the players can keep track of the position of the base runners. Of course, at times, disagreements may occur as to how far a runner may advance based on the outcome of the ball being struck by the batter. This can add to the enjoyment of the game play. Also, it will be appreciated that recording of the score, the innings, the number of outs, the positions of the base runners, etc., is all accomplished without any electrical or electronic components or elements.

Figure 8:
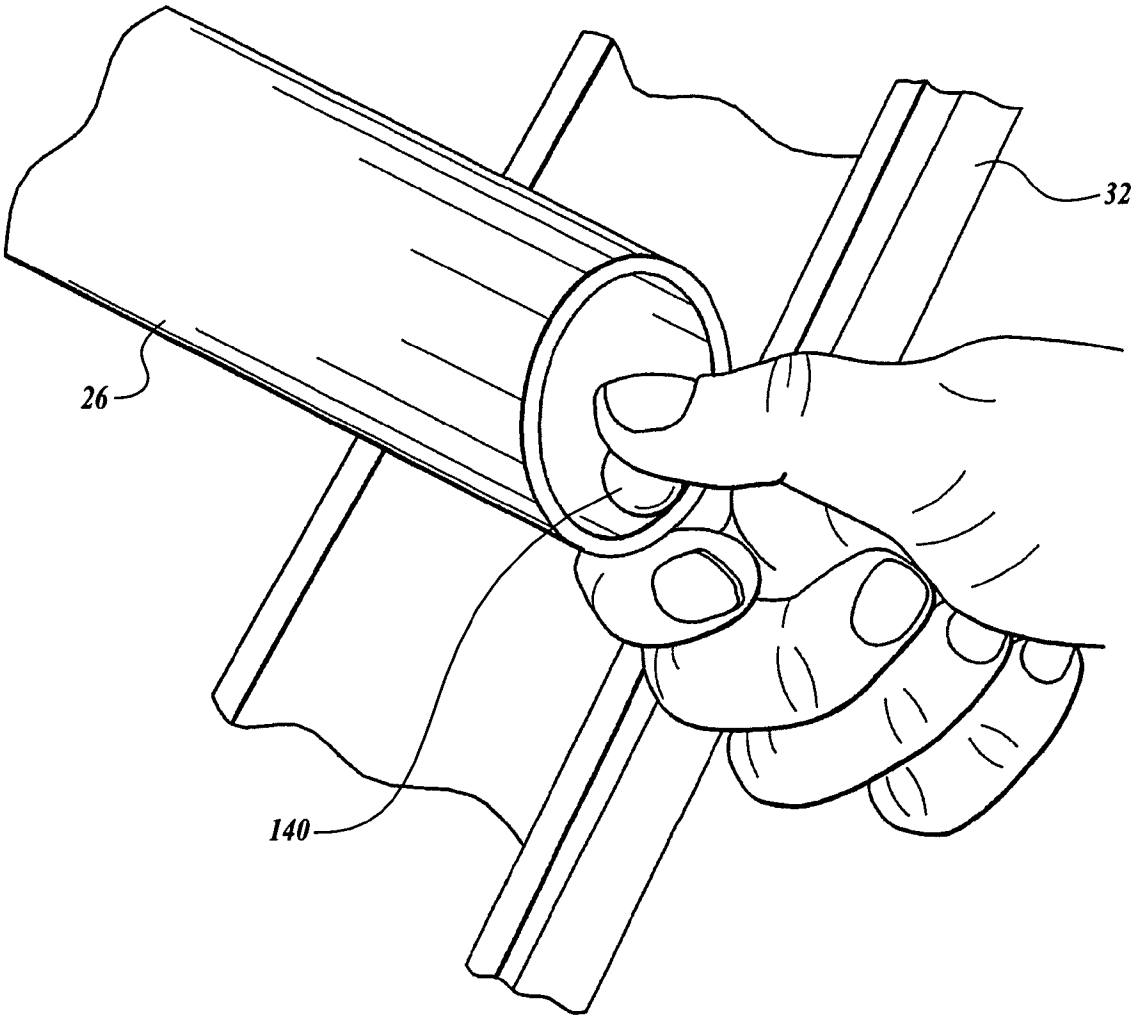
FIG. 8 is a pictorial view showing the distal end of the pitching pipe illustrating one manner in which the ball might be "pitched" by the player.

During the playing of the game, a ball 140 is rolled down the rearward end of the downward-sloped pitching tube or pipe 26 by the person serving as pitcher (see FIG. 8). The ball exits the forward end of the pipe 26 and rolls toward home plate 27, whereupon the person serving as the batter controls the batting rod 50, thereby attempting to hit the ball 140 by swinging the bat 80. If the ball is struck and rolls forward such that it passes through one of the openings 118A-118E in the outfield fence 100, then a single, double, or triple is scored, depending on which opening the ball passes through. Also, if the ball travels up ramp 116, it may fly over the fence 100 and score a home run. A home run also occurs if the ball enters the proximal or forward end of the pitching pipe 26 and passes out the rear end of the pipe. However, if the batted ball is retained inside of the fence 100 in fair territory, then an out is recorded.

With respect to pitching, the smooth, slippery surface inside the pipe, combined with the felt or other surface material of the field, allows the pitcher a great deal of influence over the speed and path of the baseball 140 as it rolls toward home plate 27. By varying the initial placement of the baseball in the pipe in the lateral direction, adding a spin to the release, and combining those variables with assorted finger placements and pressures, a wide variety of pitches can be thrown.

Pitching is considered by many to be the most creative and enjoyable part of the game. Although the ball can be simply placed in the middle of the pipe 26 and released, many different pitches can be "thrown" by the player by altering the manner in which the ball is held and/or released, and/or where the ball is placed in the pipe. For example, fastballs of various speeds are achieved by squeezing the ball down hard with the thumb inside the pipe and the index finger underneath (see FIG. 8). The scoreboard 110 sits atop the pipe to shield pitch selections.

A basic curve is "thrown" by allowing the ball to slip off the left side of the thumb at the rear edge of the pipe; a slider generally slips off to the right. With practice, the ball "bites" a desired amount into the felt or other fabric or material of the playing surface about halfway through the infield, resulting in an arc that renders the baseball impossible to hit because the fixed bat does not extend beyond the outside edge of the plate. Changeups can look and sound like fastballs until the backspin placed on the ball causes the ball to slow down before reaching the batter's box and then roll at a slower speed toward the plate.

It is possible to make the foregoing pitches because the pitching pipe 26 is significantly larger in inside diameter than the diameter of the ball 140. This allows the ball to roll along the side of the pitching pipe, for example, when pitching a curve or a slider, or other type of pitch. Also, the inside diameter is large enough to enable the player's thumb or other finger to fit therein when pitching the ball. Preferably, the diameter of the pitching pipe is about from 2 to 5 times the diameter of the ball. Moreover, preferably the inside surface of the pitching pipe is smooth so as not to create any substantial friction with the ball; rather, the ball retains the spin placed thereon during the play or when pitching. Instead, the surface of the playing field 22 is designed to frictionally interact with the ball, causing the ball to curve or otherwise move, depending on the type of pitch made.

The pitching pipe is shown as approximately 13.5 inches in length. It can be somewhat short or longer depending on various factors, for instance, the desired difficulty to hit the ball and the weight or density of the ball used. For example, it is contemplated that the pitching pipe could range from as short as about 7 to 8 inches, to as long as at least 20 inches. The change in the length of the pitching pipe can alter the distance from the exit end of the pipe to home plate. This can affect the time the batter has to react to the ball and also affect the influence of the playing field surface 22 on the pitched ball. Also, the pitching pipe is shown of fixed inside diameter. Alternatively, the pitching pipe could be tapered in the forward direction; however, doing so might somewhat limit the lateral trajectory of the ball as it travels toward home plate.

The batting mechanism is somewhat like the flipper of a pinball machine but in a non-electrical, purely mechanical form that feels like real hitting. As explained above, the bat mechanism has an upright shaft or pivot post that fits into a hole, extending down beneath the playing surface. A geared batting rod slides back and forth through sleeves under the playing field and meshes with a pinion on the pivot post, swinging the bat above. The entire underside of the game is enclosed. A hole is formed at both the batting end and at the pitching end of the perimeter frame 32 for the batting rod 50. The rod travels in and out from the base of the game unit on both ends. This allows the game to be played alone from the pitching position by swinging the bat with one hand and pitching with the other. When the batter pulls back, the desired gear ratio makes one swing counterclockwise from a stationary position at about 6 o'clock, to a stop position at about 10 o'clock. This allows the barrel of the bat to follow through in a natural way.

The ball return described above allows the batter to grab a handful of balls and send them back to the pitcher without interrupting the flow of the game. As described, the ball return consists of a small-diameter tube that runs the length of the game unit, sloping downward to deliver balls back to the pitcher.

The general rules of baseball apply, with a few special rules adapted for the game:

Before a pitch, the batter must position the bat at 6 o'clock, parallel to the centerline of the plate. Otherwise, the batter could endlessly foul off pitches.

Any pitched ball so far inside that it hits the batter's bat without the batter swinging is scored as a ball.

Pitchers may not throw a ball so hard that the ball bounces on the playing field on its way to the plate; this is also scored as a ball.

A batted ball coming to rest in fair territory is an out, no matter where it has been, fair or foul, up until its final resting point.

If a batted ball bounces off a fence and back within the path of the bat, it is considered dead and is scored a foul ball. The batter may not hit the same pitched ball twice.

Players agree on ball and strike calls, with the final decision resting with an umpire, if present. Baseballs can be used as markers to keep track of the runners on base and the number of outs. As mentioned above, there are two ways to hit a home run. The batter can hit the ball back up the pitching pipe and over the outfield wall, or using one of the small ramps 116 in the infield, launch a home run over the outfield fence.

It can be appreciated that the difficulty of hitting can be altered by changing the size and positions of the openings formed in the outfield fence that correspond to singles, doubles, and triples. Also, the size and placement of the ramp(s) 116 can be altered to change the difficulty in hitting a home run.

Figure 9:
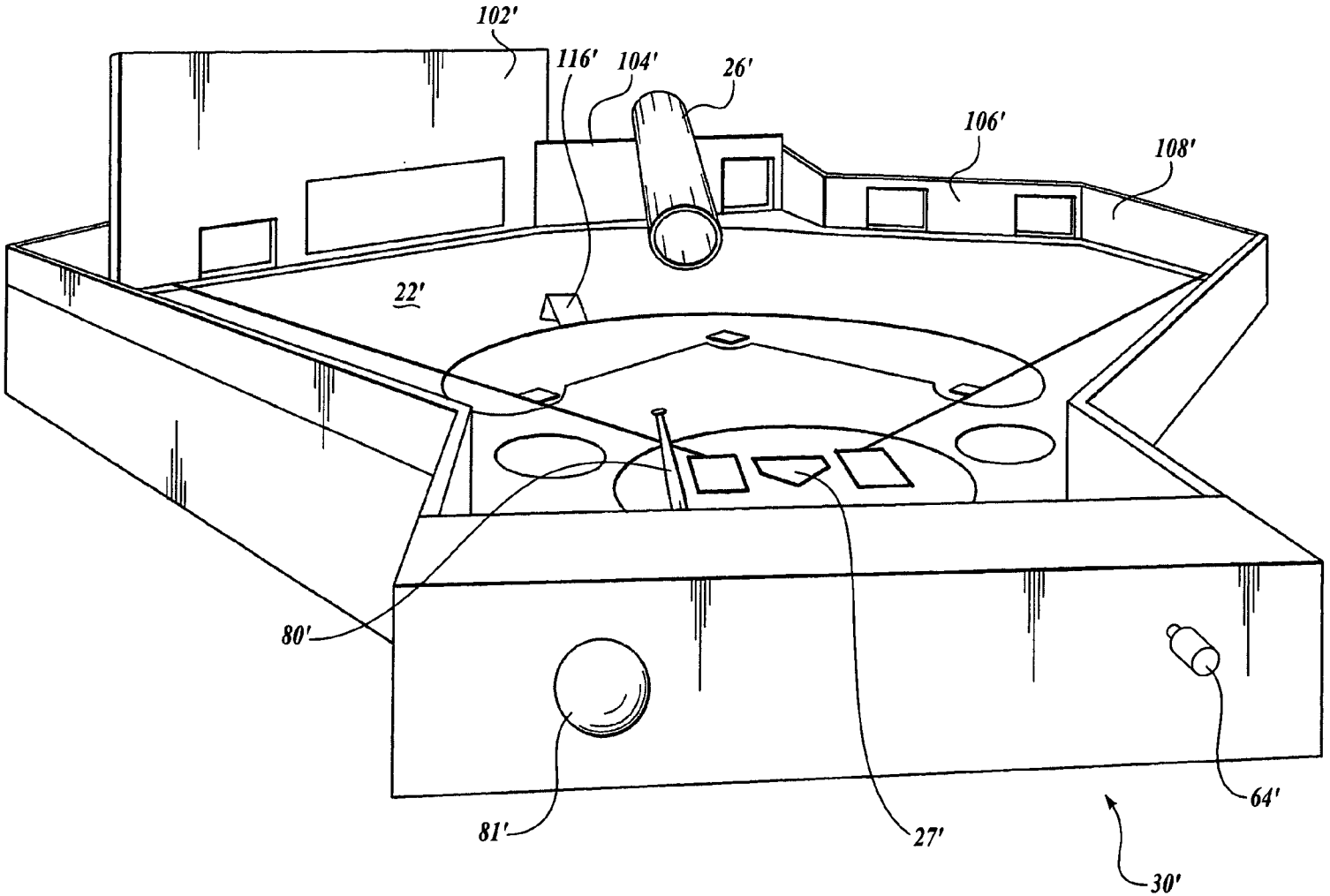
FIG. 9 is a pictorial view similar to FIG. 1, with the outfield fences configured to a different ballpark than shown in FIG. 1.

FIG. 9 shows a ballpark having outfield fences configured differently than that shown in either FIG. 1 or FIG. 7. The components shown in FIG. 9 that correspond to FIGS. 1 and 7 are given the same part numbers, but with a prime ("") designation. It will be appreciated that a different ballpark configuration can be provided by simply removing the field playing surface 22 together with the outfield fence 100 and replacing it with a different playing surface and different outfield fence configuration. The playing surface 22 can be detached from the base unit 30 by simply loosening the screw, Velcro®, or other means used at the proximal end of the pitching pipe 26 to attach the pipe to the playing surface, and then removing the pivot post 72 that supports the bat 80. The playing surface can then be conveniently lifted up and off the upper board 43.

The balls 140 used with the present game may be of various configurations. It has been found that in one embodiment of the present disclosure, the balls may be composed of steel or similar metal having a diameter about one-half inch. However, balls of other sizes and compositions may also be used with the present invention. Further, the balls may be smooth or they may include simulated seams as on a real baseball. Moreover, the exterior surface of the balls may be otherwise textured as desired so as to interact with the playing field surface in a specific manner.

While illustrative embodiments have been illustrated and described, it will be appreciated that various changes can be made therein without departing from the spirit and scope of the invention. For example, the base unit 20 and the bat can be composed of wood to help give the game play the "natural" sound of a wooden bat hitting a ball. However, other materials can be used; for example, a durable plastic material.

Also, the standard base unit 30 can be constructed in manners other then described above. For example, fewer or more bracing members 36 can be used than the three described above.

The embodiments of the invention in which an exclusive property or privilege is claimed are defined as follows:

1. A baseball simulation game comprising:

(a) a base frame structure;

(b) a playing surface having an infield section and an outfield section, the infield section having a home plate location;

(c) a manually operable batting assembly comprising a swingable bat for hitting a ball;

(d) an elongate pitching pipe directed from the outfield section toward the home plate location, said pitching pipe having an exit end portion located relatively proximal to the home plate location and an entrance end portion located relatively distal to the home plate location, being diametrically enclosed substantially along its entire length; and having an inside diameter at least one and one-half times larger than the diameter of the ball and such inside diameter being smooth; and (e) wherein the playing surface is composed of a material capable of imparting significant friction against the ball as the ball rolls on the playing surface relative to the level of friction imposed on the ball by the pitching pipe.

2. The baseball simulation game according to claim 1, wherein the internal diameter of the pitching pipe is about two to five times the diameter of the ball.

3. A baseball simulation game according to claim 1, wherein the pitching pipe is sloped downwardly in the direction toward the home plate location.

4. A baseball simulation game according to claim 1, wherein the pitching pipe has an exit end portion located in the outfield section of the playing surface.

5. The baseball simulation game according to claim 4, wherein the pitching pipe has an entrance end portion positioned beyond the playing surface outfield section relative to the location of home plate.

6. The baseball simulation game according to claim 1, wherein the pitching pipe has an entrance end portion that is beveled to form a shelf at the lower surface of the pitching pipe.

7. A baseball simulation game according to claim 1, wherein the playing surface is removable and replaceable.

8. A baseball simulation game according to claim 7, wherein the playing surface is configured to resemble a specific baseball field.

9. The baseball simulation game according to claim 8 further comprising an outfield fence extending upwardly from the playing surface and configured to also resemble the specific baseball field that the playing surface is configured to resemble.

10. The baseball simulation game according to claim 7, further comprising an outfield fence structure, said fence structure removable and replaceable.

11. The baseball simulation game according to claim 10, further comprising openings formed in the lower portion of the outfield fence to enable a ball struck by the manually operable bat to pass therethrough.

12. A baseball simulation game according to claim 1, further comprising an outfield fence structure positionable relative to the playing surface, said outfield fence structure comprising portions forming openings at the elevation of the playing surface to enable balls struck by the manually operable bat to pass therethrough.

13. A baseball simulation game according to claim 1, wherein said manually operable bat assembly comprising a bat and an elongate push-pull rod operably engaged with said bat, said push-pull rod being operable from a location adjacent the home plate location and also being at a location adjacent the entrance end portion of the pitching pipe.

14. A baseball simulation game according to claim 1, wherein said push-pull rod spanning across and extending beyond the playing surface, said push-pull rod having a first end portion extending outwardly beyond the perimeter of the base frame structure at a location near the home plate location and a second end portion extending outwardly beyond the perimeter of the frame base structure at a location near the entrance end portion of the pitching pipe.

15. The baseball simulation game according to claim 1, further comprising being a sight barrier located proximal to the entrance end portion of the pitching pipe to at least partially block the view of the entrance end portion of the pitching pipe when viewed from the home plate location.

16. A baseball simulation game according to claim 15, further comprising a scoreboard structure comprising said sight barrier and positioned adjacent the entrance end portion of the pitching pipe, said scoreboard structure configured to screen the adjacent end portion of the pitching pipe relative to the home plate location; the entrance end portion of the pitching pipe located beyond the location of the scoreboard structure relative to the home late location.

17. A non-electronic baseball simulation game, comprising:

(a) a underlying frame structure;

(b) a bat;

(c) manually operable bat actuating assembly for hitting a ball;

(d) a removable and replaceable playing surface positionable to overlie the frame structure, said playing surface having an infield section, a home plate location, and an outfield section, said playing surface configurable to resemble a desired baseball park;

(e) an outfield fence structure configured and positionable relative to the playing surface to resemble the desired baseball park;

(f) an elongate pitching pipe having an infeed end and an outfeed end, the outfeed end located between the outfield fence and the infield section of the playing surface, the outfeed end directed toward the home plate location, the infeed end located beyond the outfield fence structure relative to the home plate location, said elongate pitching pipe:

being circumferentially enclosed substantially along its entire length; and having an inside width at least one and one-half times the diameter of the ball, and (g) wherein the playing surface is constituted to import a significantly higher level of friction against the ball as the ball rolls on the playing surface relative to the level of friction imposed on the ball by the pitching pipe.

18. The non-electronic baseball simulation game according to claim 17, wherein the inside diameter of the pitching pipe is smooth and is from about one and one-half to about five times the diameter of the ball.

19. A non-electronic baseball simulation game according to claim 17, wherein said manually operable bat actuating assembly comprising a bat and an actuating rod operably engaged with the bat, the push-pull rod having a first manually graspable portion located adjacent the home plate location and a second manually graspable portion located adjacent the infeed end portion of the pitching pipe and beyond the outfield fence structure relative to the home plate location.

* * * * *

UNITED STATES PATENT AND TRADEMARK OFFICE

CERTIFICATE OF CORRECTION

PATENT NO. : 7,648,141 B2
APPLICATION NO. : 12/118490
DATED : January 19, 2010
INVENTOR(S) : D. Strohm It is certified that error appears in the above-identified patent and that said Letters Patent is hereby corrected as shown below:

| COLUMN | LINE | ERROR |
|---|---|---|
| 12 (Claim 16, line 8) | 6 | "home late" should read --home plate-- |
| 12 (Claim 17, line 3) | 9 | "a underlying" should read --an underlying-- |

Signed and Sealed this
Fifteenth Day of February, 2011

David J. Kappos

David J. Kappos
*Director of the United States Patent and Trademark Office*